US007938629B2

(12) United States Patent
Yagi et al.

(10) Patent No.: US 7,938,629 B2
(45) Date of Patent: May 10, 2011

(54) FLUORESCENT LAMP, LUMINAIRE AND METHOD FOR MANUFACTURING FLUORESCENT LAMP

(75) Inventors: Hiroshi Yagi, Osaka (JP); Yoshio Manabe, Osaka (JP); Tsuyoshi Terada, Hyogo (JP)

(73) Assignee: Panasonic Corporation, Osaka (JP)

( * ) Notice: Subject to any disclaimer, the term of this patent is extended or adjusted under 35 U.S.C. 154(b) by 233 days.

(21) Appl. No.: 12/424,093

(22) Filed: Apr. 15, 2009

(65) Prior Publication Data

US 2009/0218927 A1 Sep. 3, 2009

Related U.S. Application Data

(62) Division of application No. 10/597,658, filed as application No. PCT/JP2005/011456 on Jun. 22, 2005, now Pat. No. 7,538,479.

(30) Foreign Application Priority Data

Jul. 30, 2004 (JP) ..... 2004-224877
Dec. 24, 2004 (JP) ..... 2004-374173

(51) Int. Cl.
*F01B 37/02* (2006.01)

(52) U.S. Cl. ..... 417/49; 209/174

(58) Field of Classification Search ..... None
See application file for complete search history.

(56) References Cited

U.S. PATENT DOCUMENTS 4,071,288 A 1/1978 Evans et al.
4,145,634 A * 3/1979 Evans et al. ..... 313/490
4,924,142 A 5/1990 Kaldenhoven
6,611,091 B2 8/2003 Honmou et al.
6,650,041 B1 11/2003 Speer et al.
6,910,932 B2 6/2005 Brumleve et al.
2001/0038264 A1* 11/2001 Brumleve et al. ..... 313/565
2002/0057059 A1* 5/2002 Ogishi et al. ..... 313/636
2003/0011309 A1 1/2003 Haitko et al.
2003/0151351 A1* 8/2003 Stafford et al. ..... 313/490
2005/0062397 A1 3/2005 Izumi et al.
2005/0162089 A1* 7/2005 Iida et al. ..... 313/634
2006/0164000 A1 7/2006 Nishimura et al.

FOREIGN PATENT DOCUMENTS

JP 45-20754 7/1970
JP 64-72452 3/1989
JP 6-283102 10/1994
JP 3027006 1/2000

(Continued)

*Primary Examiner* — Ashok Patel
(74) *Attorney, Agent, or Firm* — Hamre, Schumann, Mueller & Larson, P.C.

(57) ABSTRACT

A fluorescent lamp is configured so that a glass bulb has a phosphor film formed on its internal face, and a rare gas and an amalgam pellet are enclosed therein. The amalgam pellet contains zinc, tin, and mercury as principal components, one amalgam pellet is enclosed in the glass bulb, and the amalgam pellet has a weight of not more than 20 mg. The fluorescent lamp satisfies the relationship expressed as: $45\times(1-A)\leqq x\leqq 55\times(1-A)$, $75A\leqq y\leqq 85A$, $45-30A\leqq z\leqq 55-30A$, and $x+y+z\leqq 100$, where x represents a content of zinc contained in the amalgam pellet in percent by weight, y represents a content of tin therein in percent by weight, and z represents a content of mercury therein in percent by weight. This configuration allows the fluorescent lamp to be characterized in that an amount of released mercury that is necessary for the first lighting of the fluorescent lamp is secured, and that the phosphor film is less prone to being peeled due to the amalgam.

5 Claims, 10 Drawing Sheets

FOREIGN PATENT DOCUMENTS

| | | |
|---|---|---|
| JP | 2000-251836 | 9/2000 |
| JP | 2001-15066 | 1/2001 |
| JP | 2003-531457 | 10/2003 |
| JP | 2005-310525 A | 11/2005 |
| WO | WO 94/18692 | 8/1994 |
| WO | WO 01/78858 | 10/2001 |

* cited by examiner

FLUORESCENT LAMP, LUMINAIRE AND METHOD FOR MANUFACTURING FLUORESCENT LAMP

This application is a division of U.S. application Ser. No. 10/597,658, filed Aug. 2, 2006, which is a U.S. National Stage application of International Application No. PCT/JP2005/011456, filed Jun. 22, 2005, which application is incorporated herein by reference.

TECHNICAL FIELD

The present invention relates to an amalgam-enclosed fluorescent lamp, an illumination device including the fluorescent lamp, and a method for manufacturing the fluorescent lamp.

BACKGROUND ART

The amount of mercury required to be enclosed in the lamp desirably is as small as possible from the viewpoint of environmental protection. Therefore, it is required that a minimum amount of mercury should be enclosed in a glass bulb with high precision.

However, mercury has a high surface tension, which makes it difficult to measure off a small amount of the same accurately. Besides, since it tends to adhere to a wall of a discharge thin tube or the like, the loss of mercury occurring during enclosure is considerable. Therefore, conventionally, an amalgam of mercury in a pellet form has been enclosed in place of pure mercury.

For instance, the patent document 1 discloses a fluorescent lamp in which an amalgam containing mercury and zinc as principal components (hereinafter referred to as ZnHg) is enclosed. The patent document 2 discloses a fluorescent lamp in which an amalgam containing mercury and tin as principal components (hereinafter referred to as SnHg) is enclosed.

Problems have arisen in the configurations with ZnHg and SnHg, respectively. The problem with the configuration with ZnHg is that in a manufacturing process, when an amalgam pellet is brought into a heated glass bulb, an amount of mercury vapor released from the amalgam pellet is small. It is known generally that upon the first lighting of the fluorescent lamp, mercury vapor is consumed rapidly due to physical adsorption onto an internal wall of the glass bulb or chemical reaction with a phosphor-film-forming material or an impurity gas, causing the mercury vapor level to tend to be insufficient. Further, recently, with a view to improving the lamp efficiency, the internal diameter of the glass bulb tends to decrease while the discharge path tends to increase, thereby making it difficult to cause mercury vapor to spread throughout the glass bulb, which makes the mercury vapor level more insufficient. If a fluorescent lamp is left to be on for a long time in such a state of insufficient mercury vapor, lighting defects such as non-lighting or flickering occur, or a circuit for lighting is overloaded. Therefore, problems of lighting defects, etc. tend to occur in a fluorescent lamp in which ZnHg is used.

On the other hand, the problem lying in the configuration with SnHg is that an amalgam pellet is heavy. Since the mercury content of SnHg is smaller than that of ZnHg, when SnHg is used, the weight of an amalgam pellet has to be increased further so as to enclose the same amount of mercury as that in the case of ZnHg. If an amalgam pellet is heavy, the amalgam pellet tends to cause the phosphor film to peel off when it collides against a phosphor film due to vibration during transportation or the like, thereby impairing the appearance of the fluorescent lamp, etc.

It should be noted that an amalgam pellet of SnHg is stable in the case where the mercury content therein is in a range of 15.8 wt % to 29.7 wt %, and in the case where the mercury content is set to be more than that, mercury leaks out of the amalgam pellet in some cases. Therefore, it is difficult to increase an amount of enclosed mercury by increasing the mercury content in the pellet.

Patent document 1: JP 3027006 B

Patent document 2: JP 2000-251836 A

DISCLOSURE OF INVENTION

In light of the foregoing problems, the present invention provides a fluorescent lamp that is characterized in that an amount of released mercury vapor that is necessary for the first lighting of a fluorescent lamp is secured, and that a phosphor film is less prone to peeling due to an amalgam, an illumination device that includes such a fluorescent lamp, and a method for manufacturing such a fluorescent lamp.

A fluorescent lamp of the present invention is a fluorescent lamp including a glass bulb provided with a phosphor film on its internal face, in which a rare gas and an amalgam pellet are enclosed. This fluorescent lamp is characterized in that: the amalgam pellet contains zinc, tin, and mercury, one or a plurality of the amalgam pellets are enclosed in the glass bulb, and each of the amalgam pellets has a weight of not more than 20 mg; and the fluorescent lamp satisfies the relationship expressed as:

$$45\times(1-A)\leqq x\leqq 55\times(1-A),$$

$$75A\leqq y\leqq 85A,$$

$$45-30A\leqq z\leqq 55-30A, \text{ and}$$

$$x+y+z\leqq 100,$$

where A represents a value whose lower limit is determined as:

$$A\geqq 0.3-(S/25) \text{ and } A\geqq 0.1 \text{ when } 0<L^2/D\leqq 1.5\times 10^4,$$

$$A\geqq 0.4-(S/25) \text{ and } A\geqq 0.2 \text{ when } 1.5\times 10^4<L^2/D\leqq 5\times 10^4, \text{ or}$$

$$A\geqq 0.5-(S/25) \text{ and } A\geqq 0.3 \text{ when } 5\times 10^4<L^2/D<8.5\times 10^4,$$

where D represents an internal diameter of the glass bulb in millimeters,

L represents a length of a discharge path in millimeters,

S represents a surface area of the amalgam pellet in square millimeters, x represents a content of zinc in percent by weight, y represents a content of tin in percent by weight, and z represents a content of mercury in percent by weight.

An illumination device of the present invention is characterized by including the foregoing fluorescent lamp.

A fluorescent lamp manufacturing method of the present invention is a method for manufacturing the foregoing fluorescent lamp, and is characterized by including the steps of: forming the phosphor film on the internal face of the glass bulb; and enclosing the amalgam pellet in the glass bulb, wherein in the amalgam enclosing step, the glass bulb is kept at a temperature of not lower than 260° C.

BRIEF DESCRIPTION OF DRAWINGS

FIG. 2A illustrates members composing a glass mount, and FIG. 2B illustrates the glass mount after the assembling.

FIG. 3A illustrates a state of application of a phosphor suspension in the phosphor film forming step, and FIGS. 3B and 3C illustrate states before and after the enclosure of the glass mounts in the electrode enclosing step, respectively.

FIG. 7A illustrates a state prior to the bending, while FIG. 7B illustrates a state after the bending.

DESCRIPTION OF THE INVENTION

Figure 1:
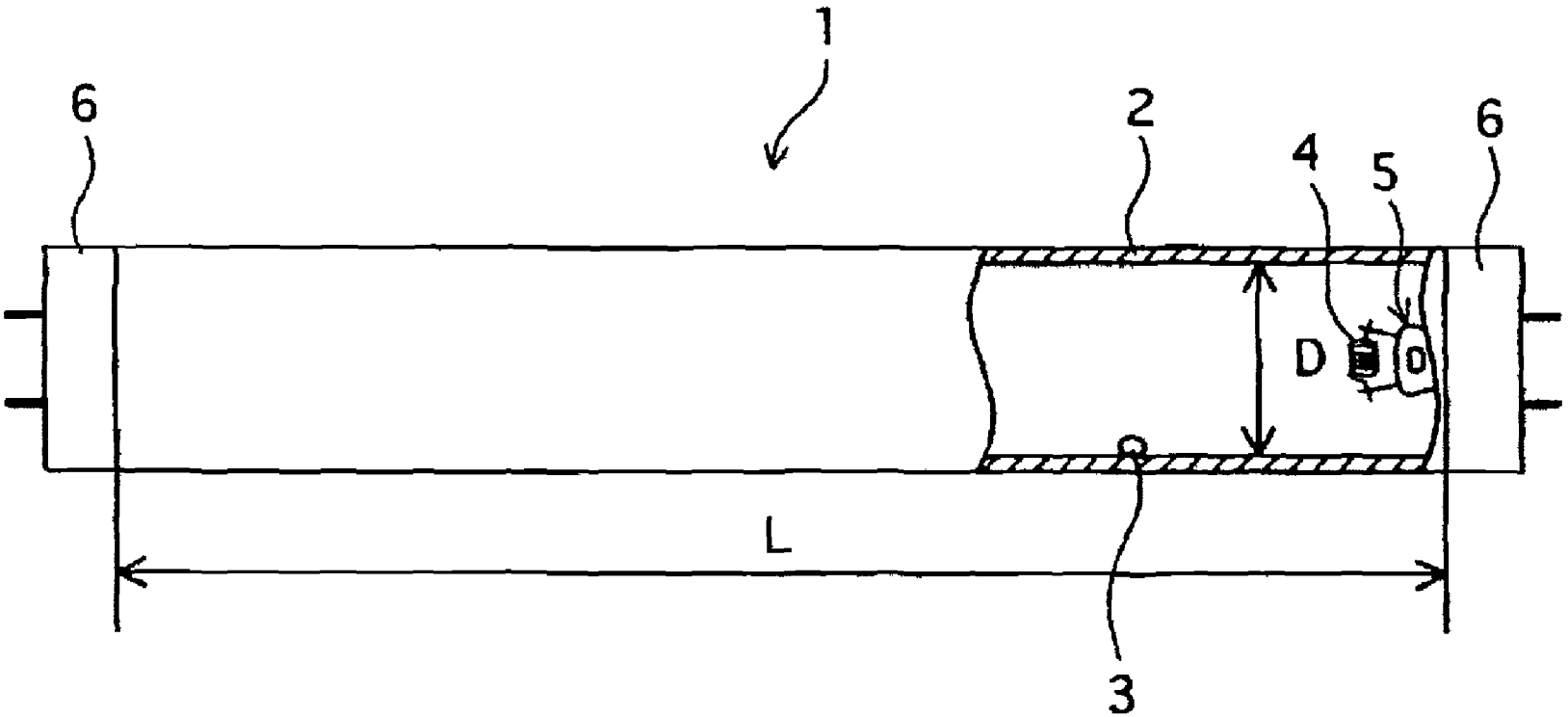
FIG. 1 is a partially cut-away plan view illustrating a straight-shape fluorescent lamp according to Example 1 of the present invention.

According to the present invention, when an amalgam pellet is put in the heated glass bulb, the amount of mercury vapor released from the amalgam pellet is greater than the amount of mercury vapor released from an amalgam pellet made of ZnHg, and therefore, the fluorescent lamp is less prone to an insufficient level of mercury vapor upon the first lighting of the fluorescent lamp, and therefore, less prone to lighting defects. In other words, it is possible to prevent the occurrence of flickering. Further, it is possible to reduce the weight of an amalgam pellet as compared with the case where SnHg is used, thereby preventing the phosphor film from being damaged or peeled by the amalgam pellet moving therein.

It should be noted that the lighting defects of a fluorescent lamp are more apt to occur with increasing difficulty in spreading of mercury vapor throughout the glass bulb. The difficulty in spreading of mercury vapor is influenced by the internal diameter D and the discharge path length L of the glass bulb. In other words, the difficulty in spreading of mercury vapor is proportional to the volumetric capacity V of the glass bulb, and is inversely proportional to the conductance C ($C=D^3/L$) of the glass bulb. Therefore, based on the following formula, hereinafter $L^2/D$ is used as an index representing the difficulty in the spreading of mercury vapor. Note that the inside of the glass bulb is regarded as a molecular flow region.

$$V/C=\pi\times(D/2)^2\times L/(D^3/L)=(\pi/4)\times(L^2/D)$$

The fluorescent lamp satisfies the relationship expressed as:

$$45\times(1-A)\leqq x\leqq 55\times(1-A),$$

$$75A\leqq y\leqq 85A,$$

$$45-30A\leqq z\leqq 55-30A, \text{ and}$$

$$x+y+z<100,$$

where A represents a value whose lower limit is determined as:

$$A\geqq 0.3-(S/25) \text{ and } A\geqq 0.1 \text{ when } 0<L^2/D\leqq 1.5\times10^4,$$

$$A\geqq 0.4-(S/25) \text{ and } A\geqq 0.2 \text{ when } 1.5\times10^4<L^2/D\leqq 5\times10^4, \text{ or}$$

$$A\geqq 0.5-(S/25) \text{ and } A\geqq 0.3 \text{ when } 5\times10^4<L^2/D\leqq 8.5\times10^4.$$

For making the amalgam pellet, a mixture of ZnHg and SnHg is used.

Here, the foregoing value A represents a ratio of SnHg in a mixture obtained by mixing ZnHg and SnHg.

Further, the above-mentioned ($L^2/D$) is indicative of the thinness of the glass bulb. As the glass bulb is thinner, the difficulty in spreading of mercury vapor increases. In such a case, the value A is increased so that mercury vapor should be generated at a greater rate. The diameter D of the glass bulb may vary within a range of 10 mm≦D≦32 mm.

A plurality of the amalgam pellets may be enclosed in the glass bulb, and each of the amalgam pellets may have a weight of not more than 15 mg. Further, the value of A preferably satisfies A<0.9. This provides an effect of reducing excessive leakage of Hg, thereby preventing a pellet from adhering to a thin tube of the fluorescent lamp when the pellet is brought into the fluorescent lamp through the tube.

The amalgam pellet preferably is in an approximately spherical shape and has an average spherical diameter of not less than 0.3 mm and less than 3.0 mm. This reduces the tendency of the amalgam to adhere to a wall face of the discharge thin tube due to static electricity or the like upon the enclosure of the amalgam, and generally, a discharge thin tube with an internal diameter of about 3 mm is less prone to catching an amalgam pellet. Therefore, this allows the work of enclosing an amalgam pellet to be carried out stably. In the foregoing configuration, the spherical shape satisfies:

$$S=4\pi((r_{max}+r_{min})/2)^2$$

where $r_{max}$ represents a maximum diameter of a pellet in an unused state prior to the enclosure in the lamp, and $r_{min}$ is a minimum diameter of the same.

The amalgam pellet preferably is made of $Zn_aSn_bHg_c$, where a, b, and c are values in percent by weight satisfying 10≦a≦30, 30≦b≦65, and 25≦c≦45. In these ranges, the flickering upon the lighting can be prevented further, and the damaging or peeling of the phosphor film can be prevented.

The foregoing amalgam pellet preferably is set so that the release of mercury begins when the temperature is above 260° C. In this range, the flickering upon the lighting can be prevented further.

The foregoing amalgam pellet further may contain less than 10 percent by weight of at least one element selected from bismuth, lead, indium, cadmium, strontium, calcium, and barium. The foregoing component may be an unavoidable impurity, or may be added on purpose. This is because the working effect of the present invention can be maintained by so doing.

An illumination device including the fluorescent lamp of the present invention is less prone to breakdowns due to non-lighting, etc., of the fluorescent lamp.

Further, since mercury vapor is allowed to spread throughout the glass bulb in the fluorescent manufacturing process, the manufacturing method of the present invention allows a fluorescent lamp to be less prone to lighting defects that tend to occur due to an insufficient level of mercury vapor upon the first lighting of the lamp.

EXAMPLES

The following describes the present invention more specifically by way of examples. The present invention, however, is not limited to the examples shown below.

Example 1

(1) Configuration of Fluorescent Lamp

FIG. 1 is a partially cut-away plan view of a straight-shape fluorescent lamp according to one example. As shown in FIG. 1, a fluorescent lamp 1 is a straight-shape fluorescent lamp exclusively for high frequencies (power consumption: 32 W), and includes a glass bulb 2 made of soda-lime glass.

The glass bulb 2 has a tube internal diameter D of 23.5 mm and a discharge path length L of 1178 mm, whereby $L^2/D$ is 59050. On an internal face thereof, a protective layer and a phosphor film (not shown) are laminated successively, while an amalgam pellet 3 for supplying mercury vapor and argon gas as rare gas are enclosed therein. Glass mounts 5 having electrodes 4, respectively, are fixed in both ends of the glass bulb 2 so as to be enclosed in the bulb, and the ends of the glass bulb 2 are capped with bases 6, respectively.

The amalgam pellet 3 is in an approximately spherical shape, having an average spherical diameter of 1.2 mm, a weight of 11.5 mg (the mercury content of the same is 3 mg), and a surface area S of 4.5 $mm^2$. One amalgam pellet 3 is enclosed in the glass bulb 2. The amalgam pellet 3 is made of an amalgam containing zinc, tin, and mercury as principal components (this amalgam is hereinafter referred to as ZnSnHg), and the above described value A, value x (value a), value y (value b), and value z (value c) satisfy A=0.8, x=10 (a=10), y=64 (b=64), and z=26 (C=26), respectively.

(2) Fluorescent Lamp Manufacturing Method

Next, a method for manufacturing the fluorescent lamp according to the above-described Example 1 is described, with reference to FIGS. 2 to 5. The method for manufacturing a fluorescent lamp includes a mount assembling step, a phosphor film forming step, an electrode enclosing step, an air discharging step, an amalgam enclosing step, and a rare gas enclosing step.

Figure 2A:
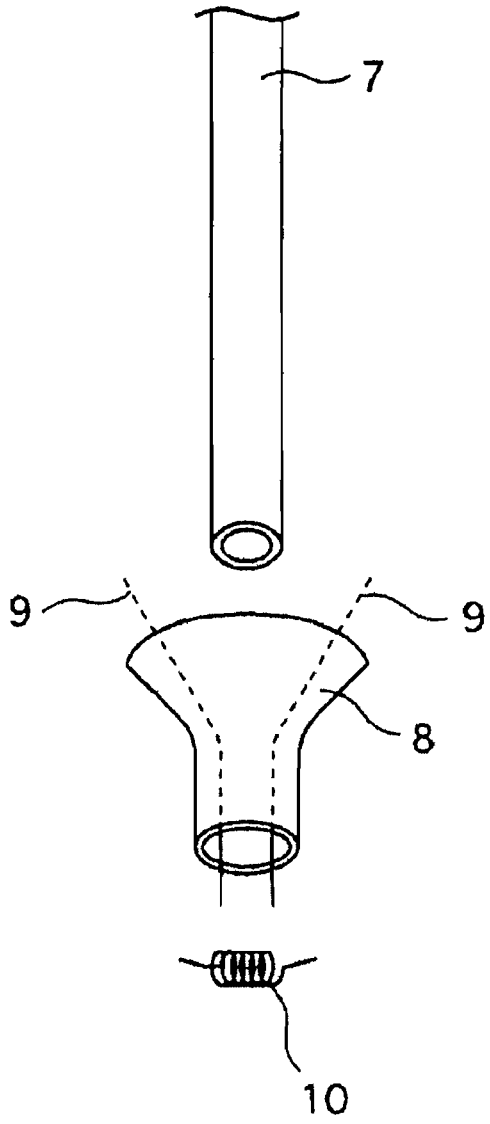
FIGS. 2A and 2B illustrate a mount assembling step according to an example of the present invention.
Figure 2B:
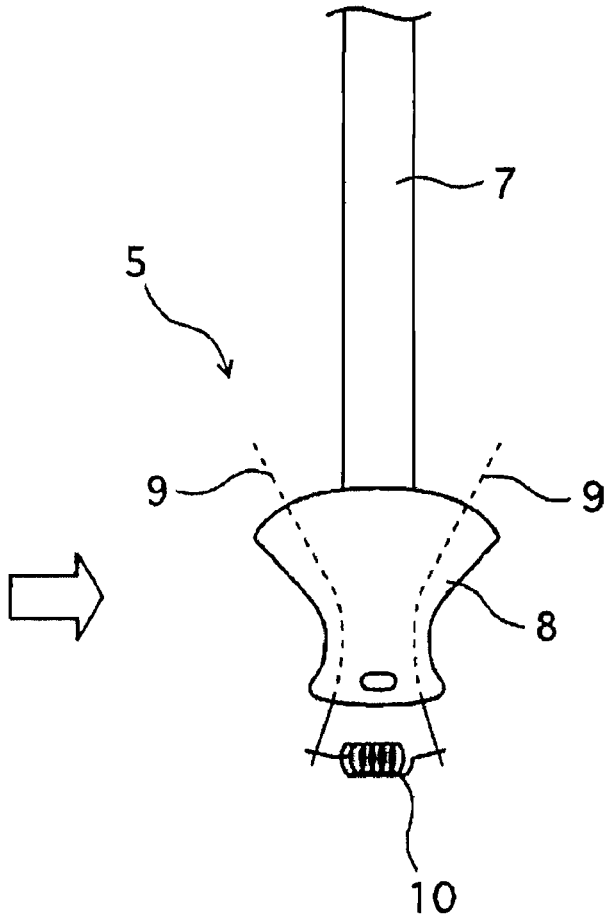

First, the glass mounts 5 are assembled in the mount assembling step. FIGS. 2A and 2B illustrate the mount assembling step. FIG. 2A shows members composing the glass mount, and FIG. 2B shows the glass mount obtained after assembling. As shown in FIG. 2A, the glass mount 5 is composed of a discharge thin tube 7, a flare 8, a pair of lead lines 9, and a coil 10, and they are assembled integrally as shown in FIG. 2B. It should be noted that each of the foregoing electrodes 4 is composed of a pair of the lead lines 9 and the coil 10.

Figures 3A, 3B, 3C:
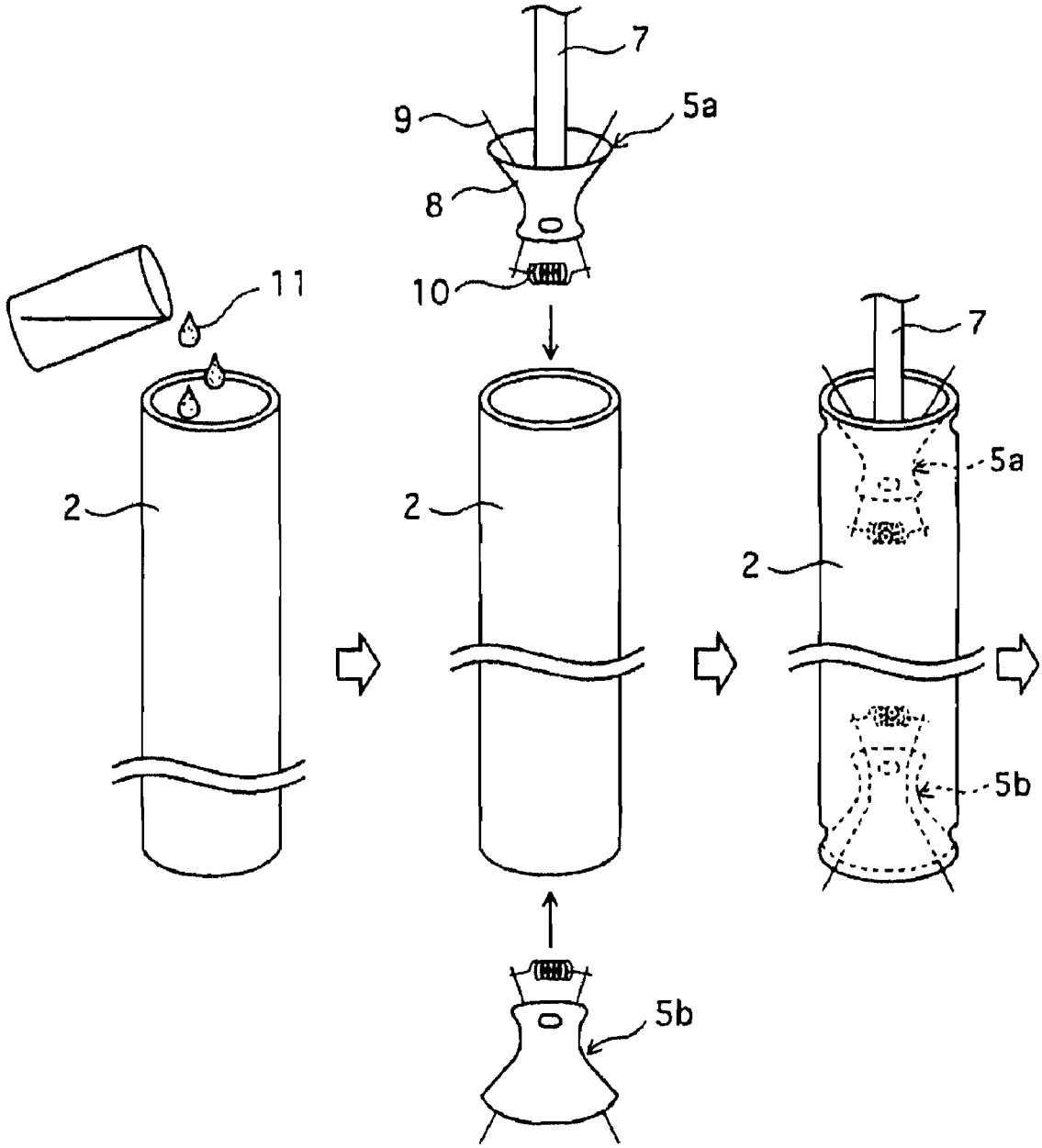
FIGS. 3A to 3C illustrate a phosphor film forming step and an electrode enclosing step according to an example of the present invention.

The phosphor film forming step is carried out in parallel with the mount assembling step. FIGS. 3A to 3C illustrate the phosphor film forming step and the electrode enclosing step. FIG. 3A illustrates a state of applying a phosphor suspension in the phosphor film forming step, and FIGS. 3B and 3C illustrate states before and after the enclosure of the glass mounts in the electrode enclosing step, respectively.

In the phosphor film forming step, a protective film is formed on the internal face of the straight-shape glass bulb 2 preliminarily. Then, as shown in FIG. 3A, the phosphor suspension 11 containing a phosphor emitting three wavelengths is poured into the glass bulb 2, and the internal face of the glass bulb is wetted by the phosphor suspension 11. Next, the phosphor suspension 11 is dried, and baked in a furnace for approximately one minute at 550° C. to 660° C., whereby a phosphor film is formed.

In the electrode enclosing step, after the phosphor film is removed partially in the vicinities of the both ends of the glass bulb 2, as shown in FIG. 3B, glass mounts 5*a* and 5*b* are inserted to the both ends, respectively, and are fixed therein at positions as shown in FIG. 3C so as to be enclosed in the bulb. It should be noted that in the manufacturing method according to the present example, a method for discharging air from only one end of the glass bulb 2 is employed, and a tip of a discharge thin tube (not shown) of the glass mount 5*b* on the other side has been cut by burning preliminarily so as to be sealed, whereby one side of the glass bulb 2 is in a sealed state.

In the air discharging step, an impurity gas in the glass bulb 2 is discharged through the non-sealed discharge thin tube 7.

Figure 4:
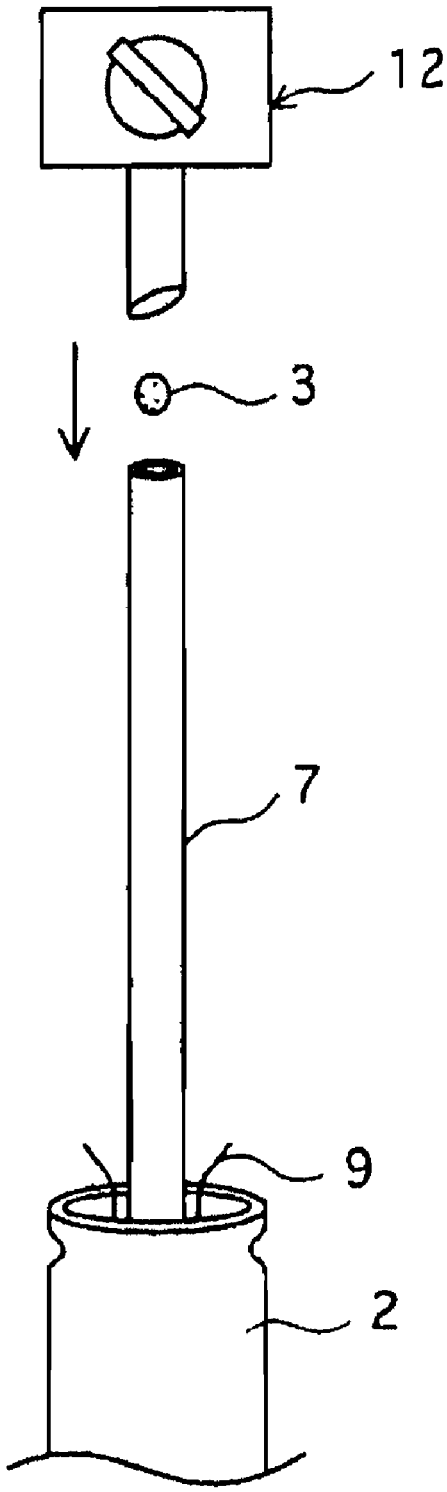
FIG. 4 illustrates an amalgam enclosing step according to an example of the present invention.

In the amalgam enclosing step, the amalgam pellet 3 is enclosed in the glass bulb 2. FIG. 4 illustrates the amalgam enclosing step. The amalgam pellet 3 is dropped from an amalgam dropping device 12 through the non-sealed discharge thin tube 7 into the glass bulb 2. Here, if an average spherical diameter of the amalgam pellet 3 is set to be not less than 0.3 mm, the amalgam 3 has less tendency to adhere to a wall of the discharge thin tube 7. On the other hand, when the average spherical diameter of the amalgam pellet 3 is set to be less than 3.0 mm, the amalgam pellet 3 has less tendency to lodge in the discharge thin tube 7.

It should be noted that the manufacturing method of the present invention does not employ a costly method such as a method of fixing the amalgam pellet 3 onto a tube end portion of the glass bulb 2 or a method of sealing the amalgam pellet 3 inside the discharge thin tube 7, but the amalgam pellet 3 is enclosed in the glass bulb 2 in a manner such that the amalgam pellet 3 is freely movable therein.

In the amalgam enclosing step, it is desirable to maintain the temperature in the glass bulb 2 to 260° C. or above so as to accelerate the release of mercury vapor from the amalgam pellet 3. This is because, as will be described later, the temperature at which the release of vapor of mercury contained in the amalgam pellet 3 starts is 260° C.

In the rare gas enclosing step, argon gas is enclosed in the glass bulb 2 via the discharge thin tube 7 at a pressure of 280 Pa, and after the enclosure, the tip of the discharge thin tube 7 is burnt so as to be cut and sealed. Finally, the bases 6 are attached to the both ends of the glass bulb 2, respectively, whereby the fluorescent lamp 1 is completed.

(3) Configuration of Illumination Device

Figure 5:
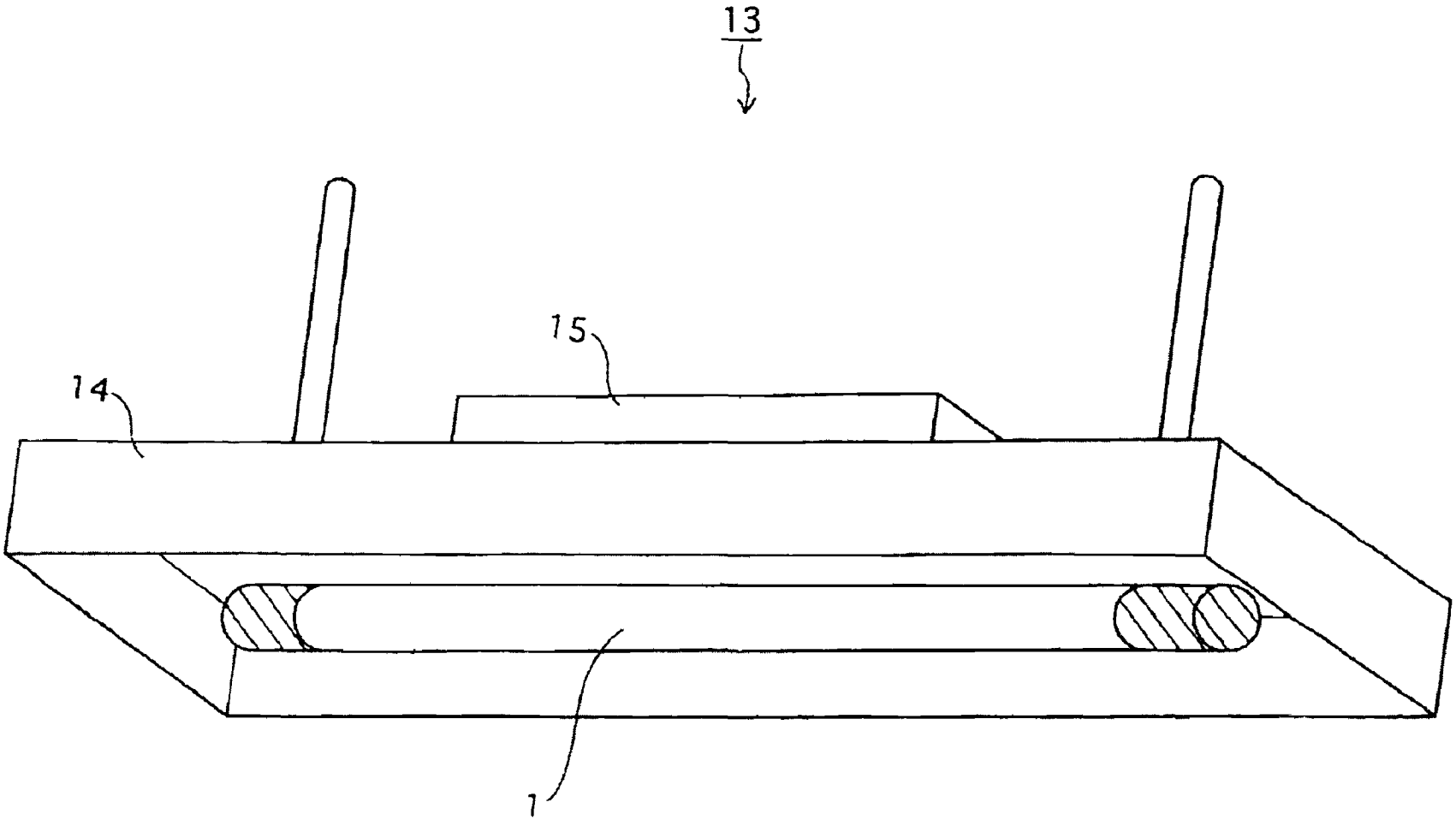
FIG. 5 is a perspective view illustrating an illumination device according to an example of the present invention.

The fluorescent lamp according to Example 1 can be used as a light source of an illumination device. FIG. 5 is a perspective view illustrating an illumination device. As shown in FIG. 5, an illumination device 13 according to the present example includes the fluorescent lamp 1 according to Example 1 as the light source. The fluorescent lamp 1 is housed in a device main body 14, and is controlled by a lighting means 15 attached to a top face of the device main body 14.

Example 2

(1) Configuration of Fluorescent Lamp

Figure 6:
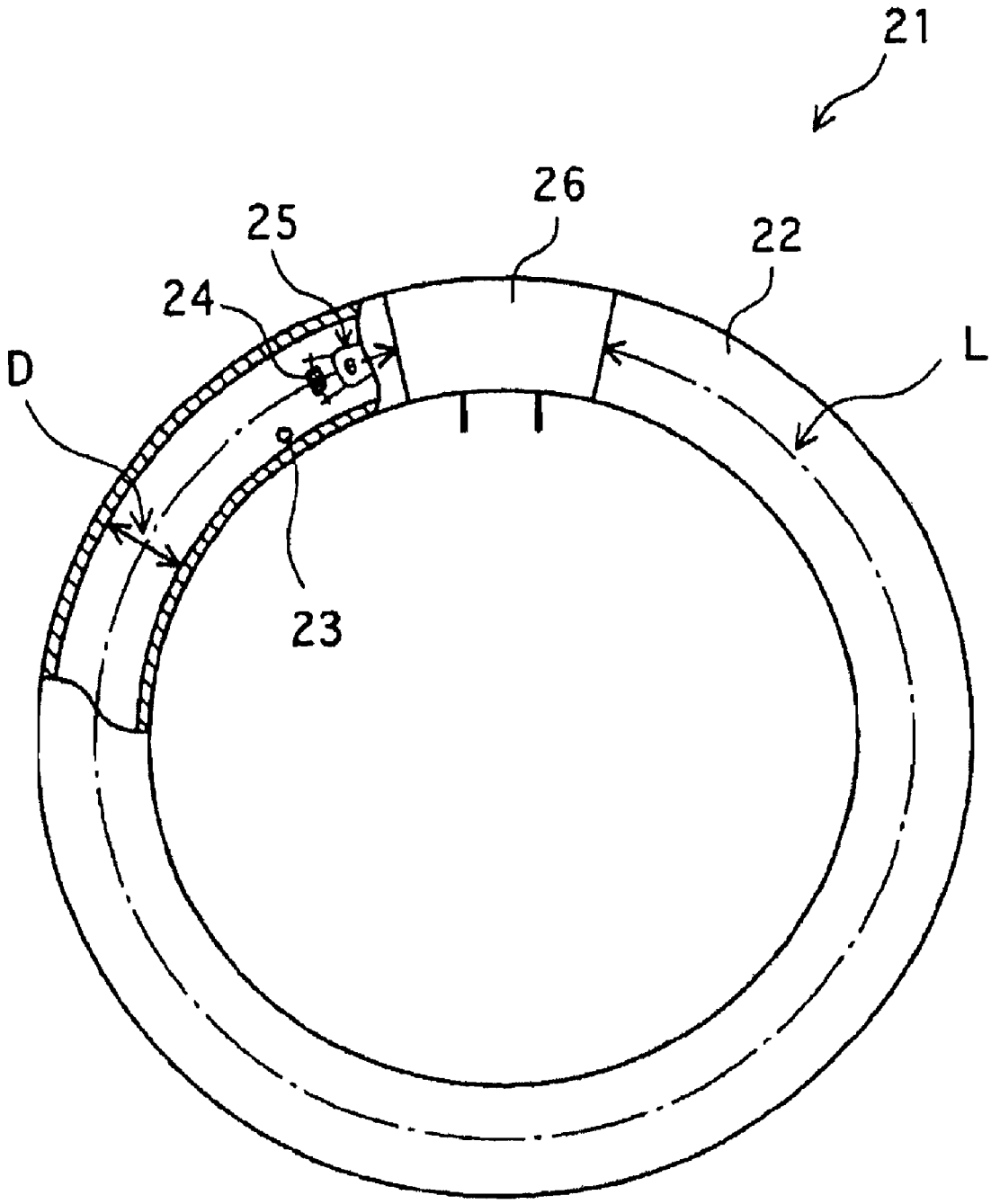
FIG. 6 is a partially cut-away plan view illustrating a ring-shape fluorescent lamp of Example 2 of the present invention.

FIG. 6 is a partially cut-away plan view illustrating a ring-shape fluorescent lamp of Example 2 of the present invention. As shown in FIG. 6, a fluorescent lamp 21 is a ring-shape fluorescent lamp (power consumption: 40 W) including a glass bulb 22 made of soda-lime glass.

The glass bulb 22 has a tube internal diameter D of 27 mm and a discharge path length L of 1026 mm, whereby $L^2/D$ is 38988. On an internal face thereof, a protective layer and a phosphor film (not shown) are laminated successively, while an amalgam pellet 23 for supplying mercury vapor and argon gas as rare gas are enclosed therein. Glass mounts 25 having electrodes 24, respectively, are fixed in both ends of the glass bulb 22 so as to be enclosed in the bulb, and a base 26 is attached to the ends of the glass bulb 22 so as to cover the same.

The amalgam pellet 23 is in an approximately spherical shape, having an average spherical diameter of 1.3 mm, a weight of 13.2 mg (the mercury content out of the same is 5 mg), and a surface area S of 5.3 $mm^2$. One of the amalgam pellet 23 is enclosed in the glass bulb 22. The amalgam pellet 23 is made of ZnSnHg, and the above described value A, value x (value a), value y (value b), and value z (value c) satisfy A=0.4, x=30 (a=30), y=32 (b=32), and z=38 (c=38), respectively.

It should be noted that the fluorescent lamp 21 according to Example 2 could be used as a light source of an illumination device, as is the case with the fluorescent lamp 1 according to Example 1.

(2) Fluorescent Lamp Manufacturing Method

Next, a method for manufacturing the fluorescent lamp according to the above-described Example 2 is described. The method for manufacturing a fluorescent lamp includes a mount assembling step, a phosphor film forming step, an electrode enclosing step, a glass bulb bending step, an air discharging step, an amalgam enclosing step, and a rare gas enclosing step. These steps except for the glass bulb bending step are identical to the steps according to the above-described Example 1. It should be noted that in the manufacturing method according to Example 2 as well, as is the case with the manufacturing method according to Example 1, the temperature in the glass bulb 22 desirably is maintained at 260° C. or above in the amalgam enclosing step.

The manufacturing method for manufacturing the fluorescent lamp according to Example 2 is different from the manufacturing method for manufacturing the fluorescent lamp according to Example 1 in that the former method includes the glass bulb bending step. The glass bulb bending step is carried out after the completion of the electrode enclosing step and prior to the air discharging step.

Figure 7A:
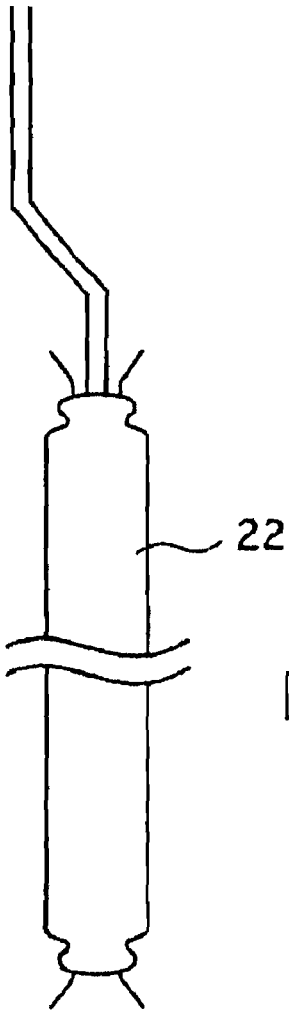
FIGS. 7A and 7B illustrate a glass bulb bending step according to an example of the present invention.
Figure 7B:
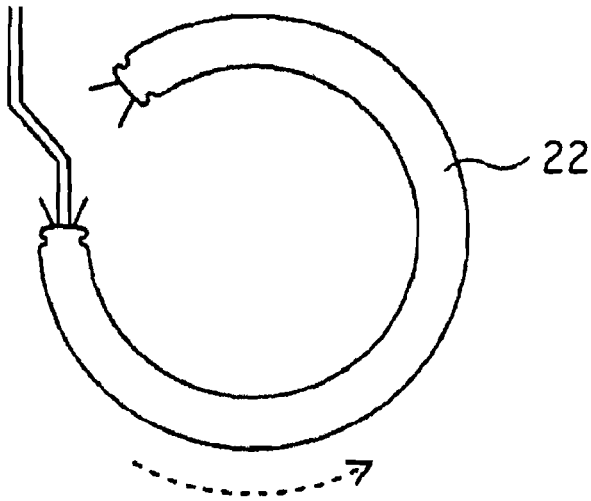

In the glass bulb bending step, the straight-shape glass bulb 22 is subjected to bending so as to have a ring shape. FIGS. 7A and 7B illustrate the glass bulb bending step. FIG. 7A illustrates a state prior to the bending, while FIG. 7B illustrates a state after the bending. The straight-shape glass bulb 22 as shown in FIG. 7A is brought into a furnace in which the atmosphere temperature is controlled at around 700° C. to 900° C., and is formed into a ring-shape glass bulb 22 as shown in FIG. 7B.

(3) Amount of Mercury Released from Amalgam Pellet

ZnHg is an amalgam principally composed of $Zn_3Hg$, and considering the phase diagram, the temperature at which mercury vapor starts to be released is 42.9° C. On the other hand, SnHg is an amalgam principally composed of $Sn_{20}Hg_3$, $Sn_7Hg$, and $Sn_6Hg$, and the temperature at which mercury vapor starts to be released is in the vicinity of 58° C. Therefore, at the temperature while the lamp is being turned on, it is presumed that an amount of released mercury from ZnHg is greater than that from SnHg.

However, since the amalgam enclosing step is carried out after the electrode enclosing step or the glass bulb bending step as described above, the temperature inside the glass bulb is 200° C. to 300° C. at the time when the amalgam pellet is enclosed. Therefore, the time when mercury vapor is released from the amalgam pellet at the highest rate is the time when the amalgam pellet is enclosed, that is, the time when the amalgam pellet is subjected to the highest temperature. Therefore, it can be considered that the amount of mercury vapor released from the amalgam pellet in the foregoing temperature range of 200° C. to 300° C. has the greatest effect on the mercury vapor pressure upon the first lighting of the lamp.

Then, respective amounts of released mercury vapor in the cases of ZnHg and SnHg in the foregoing temperature range were determined. More specifically, the amalgams were brought into chambers under atmospheric pressure, heated to 200° C. to 300° C. for about 10 minutes, and amounts of mercury having been released therefrom at predetermined temperatures in the foregoing temperature range were determined.

Table 1 shows amounts of mercury released from amalgams.

TABLE 1

| Composition | Initial Mercury Content | Amount of Released Mercury | | | |
|---|---|---|---|---|---|
| (wt %) | (mg) | 240° C. | 260° C. | 280° C. | 300° C. |
| ZnHg (50:50) | 5.0 | 0 mg (0%) | 0 mg (0%) | 0.1 mg (2%) | 0.3 mg (6%) |
| SnHg (80:20) | 3.0 | 0.1 mg (3%) | 0.2 mg (7%) | 0.4 mg (13%) | 0.6 mg (20%) |
| ZnSnHg (25:40:35) | 4.6 | 0 mg (0%) | 0.2 mg (4%) | 0.3 mg (7%) | 0.5 mg (11%) |

As shown in Table 1, the temperature at which ZnHg starts releasing mercury is in the vicinity of 280° C., while the temperature at which SnHg starts releasing mercury is in the vicinity of 240° C. Besides, when the temperature reaches 300° C., the amount of mercury having been released from ZnHg is 6%, while the amount of mercury having been released from SnHg is 20%. Therefore, in the foregoing temperature range, that is, the amount of mercury released in the temperature range, which has the greatest influence on the first lighting of the fluorescent lamp, is greater in the case of SnHg than in the case of ZnHg.

It should be noted that an amount of mercury released from an amalgam obtained by mixing ZnHg and SnHg (hereinafter referred to as ZnSnHg) is greater than that of ZnHg and smaller than that of SnHg in the foregoing temperature range.

(4) Experiments

As described above, a fluorescent lamp in which ZnHg is enclosed has a drawback in that due to a small amount of released mercury, flickering tends to occur, whereas a fluorescent lamp in which SnHg is enclosed has a drawback in that due to an increased weight of the amalgam pellet, the phosphor film tends to peel off. Therefore, fluorescent lamps were manufactured by using various ZnSnHg compositions obtained by mixing ZnHg and SnHg, and the frequencies of occurrence of lighting defects and film peeling were determined with respect to the foregoing fluorescent lamps. By so doing, conditions for manufacturing a fluorescent lamp that has none of the foregoing problems were analyzed.

1. Lighting Defects

A lighting test was carried out so as to determine the frequency of occurrence of lighting defects. In the lighting test, each fluorescent lamp was attached to a lighting device and was turned on, and whether or not a lighting defect such as non-lighting or flickering occurred was checked visually.

It should be noted that the lighting defect of a fluorescent lamp is more apt to occur with increased difficulty in spreading of mercury vapor throughout the glass bulb. The difficulty in spreading of mercury vapor is influenced by the internal diameter D and the discharge path length L of the glass bulb. In other words, the difficulty in spreading of mercury vapor is proportional to the volumetric capacity V of the glass bulb, and is inversely proportional to the conductance C ($C=D^3/L$) of the glass bulb. Therefore, based on the following formula, hereinafter $L^2/D$ is used as an index representing the difficulty in spreading of mercury vapor. Note that the inside of the glass bulb is regarded as a molecular flow region.

$$V/C=\pi\times(D/2)^2\times L/(D^3/L)=(\pi/4)\times(L^2/D)$$

Figure 8:
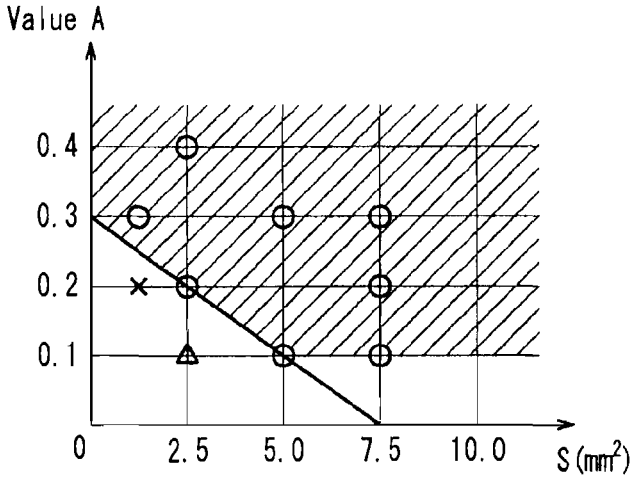
FIG. 8 is a graph showing the result of a lamp lighting test with respect to fluorescent lamps with $L^2/D=1.5\times10^4$ according to an example of the present invention.
Figure 9:
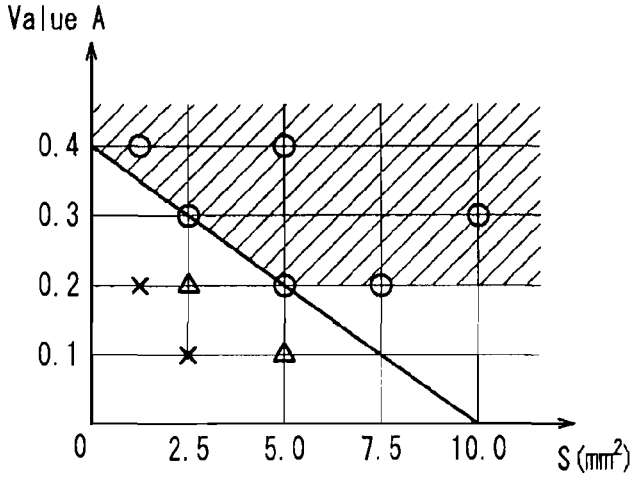
FIG. 9 is a graph showing the result of a lamp lighting test with respect to fluorescent lamps with $L^2/D=5\times10^4$ according to an example of the present invention.
Figure 10:
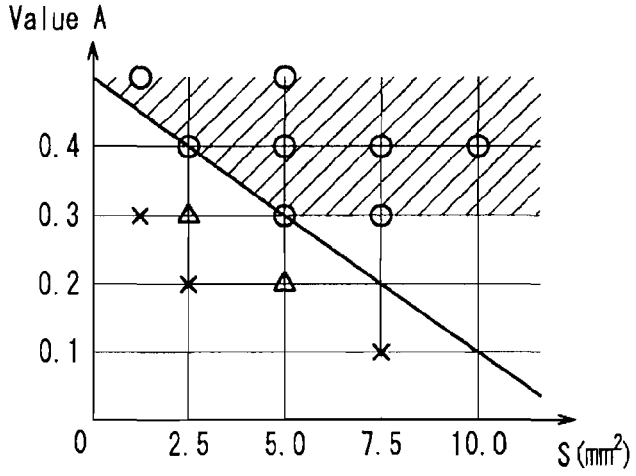
FIG. 10 is a graph showing the result of a lamp lighting test with respect to fluorescent lamps with $L^2/D=8.5\times10^4$ according to an example of the present invention.

Experiments were carried out with respect to three types of ring-shape fluorescent lamps having different internal diameters D and different discharge path lengths L of glass bulbs, respectively. FIG. 8 is a graph showing the result of a lamp lighting test with respect to fluorescent lamps (L=475, D=15) with $L^2/D=1.5\times10^4$, FIG. 9 is a graph showing the result of a lamp lighting test with respect to fluorescent lamps (L=840, D=14) with $L^2/D=5\times10^4$, and FIG. 10 is a graph showing the result of a lamp lighting test with respect to fluorescent lamps (L=1475, D=25.5) with $L^2/D=8.5\times10^4$.

In each graph, "o" indicates that a lighting defect occurred with none of 50 lamps subjected to the test, "Δ" indicates that lighting defects occurred with one or two of the same, and "x" indicates that lighting defects occurred with three or more of the same. Besides, in each graph, a hatched range indicates the range of conditions under which no lighting defect occurred.

The result shown in FIG. 8 can be interpreted to indicate that a fluorescent lamp satisfying $0<L^2/D\leqq1.5\times10^4$ is less prone to a lighting defect, provided that in the fluorescent lamp an amalgam pellet is enclosed that satisfies the following relationship:

$$45\times(1-A)\leqq x\leqq55\times(1-A),$$

$$75A\leqq y\leqq85A,$$

$$45-30A\leqq z\leqq55-30A, \text{ and}$$

$$x+y+z\leqq100,$$

where the lower limit of the value A is determined as follows:

$$A\geqq0.3 \text{ when } 0.2<S<2.5,$$

$$A\geqq0.2 \text{ when } 2.5\geqq S<5.0, \text{ and}$$

$$A\geqq0.1 \text{ when } 5.0\leqq S.$$

It should be noted that a solid line in the graph of FIG. 8 is an approximate line ($A=0.3-0.04\times S$) indicating the lower limit of the value A presumed from the experiment result.

Further, the result shown in FIG. 9 indicates that in the case of a fluorescent lamp satisfying $1.5\times10^4<L^2/D\leqq5\times10^4$, the lower limit of the value A is determined as:

$$A\geqq0.4 \text{ when } 0.2\leqq S<2.5,$$

$$A\geqq0.3 \text{ when } 2.5\leqq S<5.0, \text{ and}$$

$$A\geqq0.2 \text{ when } 5.0\leqq S.$$

It should be noted that a solid line in the graph of FIG. 9 is an approximate line ($A=0.4-0.04\times S$) indicating the lower limit of the value A presumed from the experiment result.

Further, the result shown in FIG. 10 indicates that in the case of a fluorescent lamp satisfying $5\times10^4<L^2/D\leqq8.5\times10^4$, the lower limit of the value A is determined as:

$$A\geqq0.5 \text{ when } 0.2\leqq S<2.5,$$

$$A\geqq0.4 \text{ when } 2.5\leqq S<5.0, \text{ and}$$

$$A\geqq0.3 \text{ when } 5.0\leqq S.$$

It should be noted that a solid line in the graph of FIG. 10 is an approximate line ($A=0.5-0.04\times S$) indicating the lower limit of the value A presumed from the experiment result.

2. Regarding Film Pealing

A vibration test was carried out so as to analyze the influence of the weight of an amalgam on the peeling of a phosphor film. The vibration test was carried out by vibrating a fixed fluorescent lamp under predetermined conditions (vibration acceleration: ±1.0 G, frequency range: 5 Hz to 50 Hz, sweeping method: logarithmic sweeping at ½ octave/min, repetition cycle: 798 sec), and it was checked visually whether or not film peeling occurred in the phosphor film. It has been proved that if film peeling did not occur after 27 minutes of vibration in the foregoing vibration test, an inconvenience due to film peeling should not occur in actual transportation.

Figure 11:
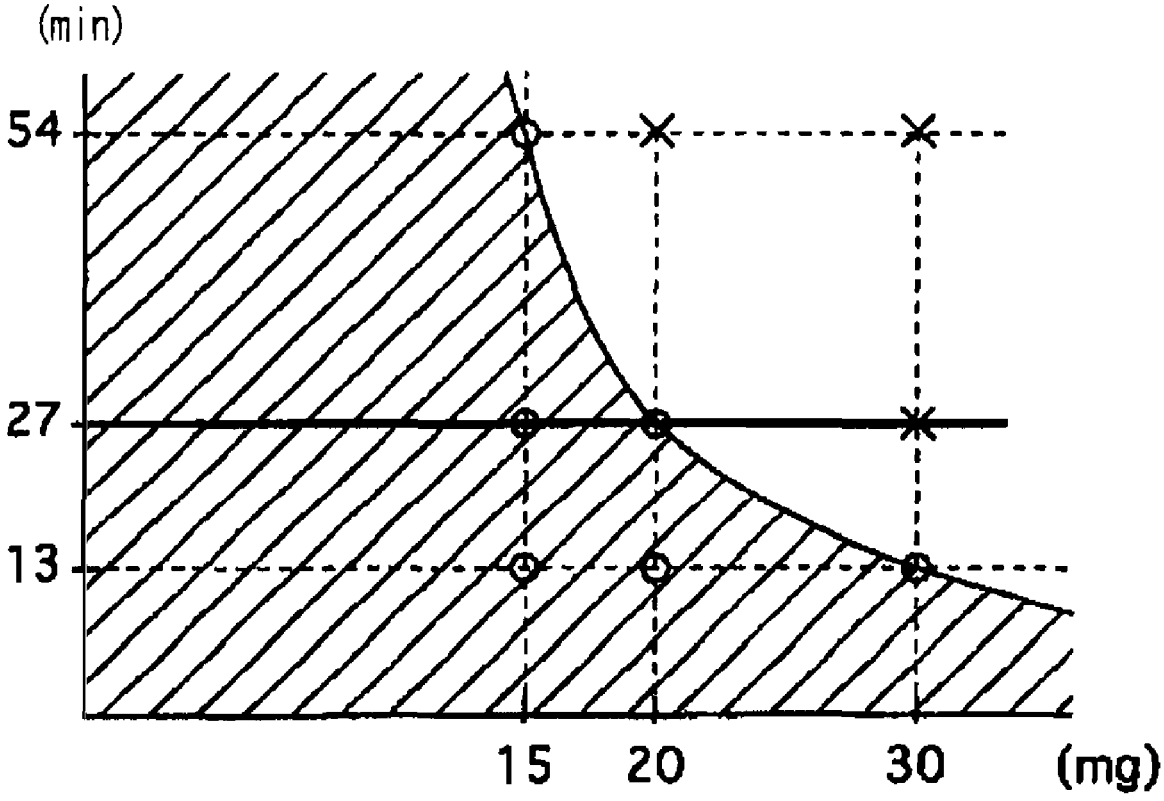
FIG. 11 is a graph showing the result of a vibration test of an example of the present invention.

FIG. 11 is a graph showing the result of a vibration test. In the graph of FIG. 11, "o" indicates that no film peeling occurred, and "x" indicates that film peeling occurred. Further, in the graph shown in FIG. 11, a hatched range is the range of conditions under which no film peeling occurred.

In the case where the weight of the amalgam pellet was 20 mg, no film peeling occurred even with vibration being applied for 27 minutes in a predetermined vibration test. Therefore, it can be concluded that in the case where one amalgam pellet is enclosed, no film peeling will occur if the weight of the amalgam pellet is set to be not more than 20 mg.

In the case where the weight of the amalgam pellet was 15 mg, no film peeling occurred even with vibration being applied for 54 minutes in a predetermined vibration test, and hence, it was determined that no film peeling would occur under approximate conditions such that two or more of 15-mg amalgam pellets are enclosed and vibration is applied for 27 minutes in the predetermined vibration test. Thus, it can be concluded that in the case where two or more amalgam pellets are enclosed, no film peeling will occur if the weight of each amalgam pellet is set to be not more than 15 mg.

3. Evaluation of Performances of Fluorescent Lamps

Fluorescent lamps of Examples 1 and 2 were subjected to the lighting test and vibration test so that performances of lamps were evaluated.

Flickering was checked visually, but it also can be determined by comparing the light start-up performances of the foregoing fluorescent lamps with that of a fluorescent lamp in which liquid mercury is enclosed. The fluorescent lamp in which liquid mercury is enclosed exhibits an excellent light start-up performance. Let a time it takes to reach 80% of the light stabilized after the lighting of the fluorescent lamp in which liquid mercury is enclosed be $T_0$, and let a time it takes to do so in the case of the fluorescent lamp in which a mercury amalgam pellet is used be $T_1$. Here, the relationship of $T_1>T_0\times1.5$ is satisfied when flickering occurs to the fluorescent lamp in which a mercury amalgam pellet is used. In other words, flickering occurs in the case where the light start-up time of the fluorescent lamp in which a mercury amalgam pellet is used exceeds 1.5 times the light start-up time of the fluorescent lamp in which liquid mercury is used. This flickering can be checked visually.

Table 2 shows evaluation results regarding the fluorescent lamps according to Example 1. As a comparative example, fluorescent lamps in which ZnHg was enclosed were used. The fluorescent lamps of the comparative example were designed to the same specifications as those of the fluorescent lamps according to Example 1 except for the amalgam pellets being made of ZnHg, which was the only difference from the fluorescent lamps of Example 1. It should be noted that all the amalgam pellets enclosed in the fluorescent lamps were prepared so that the mercury amount contained in each was set to be 3 mg.

TABLE 2

| Composition | Number of flickering or defective lamps (among 50 lamps) | Number of lamps with film peeling (among 20 lamps) |
|---|---|---|
| ZnSnHg (Example 1) | 0 | 0 |
| ZnHg (Comparative Example) | 3 | 0 |

As shown in Table 2, while no lighting defect or film peeling occurred with the fluorescent lamps 1 in which ZnSnHg was enclosed, lighting defects occurred with three of the fluorescent lamps in which ZnHg was enclosed.

Table 3 shows evaluation results regarding the fluorescent lamps according to Example 2. As a comparative example, fluorescent lamps in which ZnHg or SnHg was enclosed were used. The fluorescent lamps of the comparative example were designed to the same specifications as those of the fluorescent lamps according to Example 2 except for the amalgam pellets being made of ZnHg or SnHg, which was the only difference from the fluorescent lamps of Example 2. It should be noted that all the amalgam pellets enclosed in the fluorescent lamps were prepared so that the mercury amount contained in each was set to be 5 mg.

TABLE 3

| Composition | Enclosed amount (mg) | Number of flickering or defective lamps (among 50 lamps) | Number of lamps with film peeling (among 20 lamps) |
|---|---|---|---|
| ZnSnHg (Example 2) | 14 | 0 | 0 |
| ZnHg (Comparative Example) | 10 | 3 | 0 |
| SnHg (Comparative Example) | 25 | 0 | 6 |

As shown in Table 3, while no lighting defect or film peeling occurred with the fluorescent lamps 21 in which ZnSnHg was enclosed, lighting defects occurred with three of the fluorescent lamps in which ZnHg was enclosed, and film peeling occurred to six of the fluorescent lamps in which SnHg was enclosed.

The above-described results indicate that the fluorescent lamps 1 according to Example 1 and the fluorescent lamps 21 according to Example 2 were less prone to lighting defects and film peeling, as compared with the conventional fluorescent lamps. It should be noted that the same performance can be achieved from a fluorescent lamp other than the foregoing fluorescent lamps 1 and 21 as long as it is a fluorescent lamp according to the present invention.

Example 3

Fluorescent lamps according to Example 1 were prepared, in which amalgam pellets shown in Table 4 were enclosed, respectively, and the number of fluorescent lamps in which mercury adhered to the thin tubes was determined. The result is shown in Table 4 below.

TABLE 4

| Value A (SnHg mixture ratio) | ZnHg mixture ratio | Hg amount (mg) | Number of lamps with mercury adhesion to thin tubes (among 10 lamps) |
|---|---|---|---|
| 0.5 | 0.5 | 5 | 0 |
| 0.8 | 0.2 | 5 | 0 |
| 0.9 | 0.1 | 5 | 1 |
| 1.0 | 0 | 5 | 4 |

Table 4 shows that regarding the adhesion of mercury to the thin tube, a preferable result was obtained when $A<0.9$.

Example 4

Figure 12:
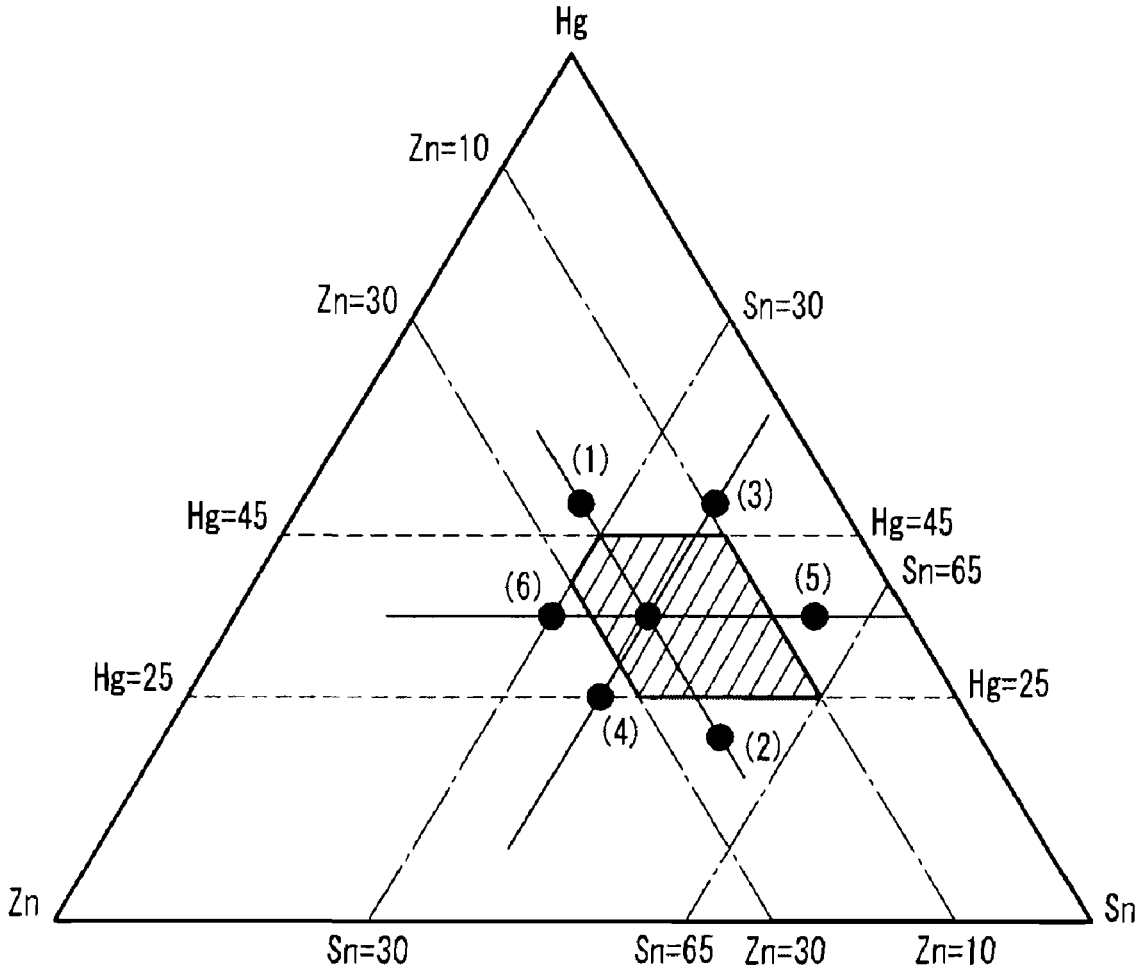
FIG. 12 is a graph showing a composition range of Example 4 of the present invention.

Fluorescent lamps according to Example 1 were prepared, in which amalgam pellets shown in Table 5 were enclosed, respectively, and the number of flickering fluorescent lamps, the number of fluorescent lamps in which film peeling occurred, and the number of fluorescent lamps in which mercury adhered to the thin tubes, were determined. The result is shown in Table 5 below. It should be noted that the evaluation was made in the same manner as those described regarding Examples 1 to 3. The composition range of the present example is shown in the graph of FIG. 12. A hatched region in FIG. 12 is a range of compositions regarded as excellent as a result of the overall evaluation shown in Table 5, and numerals in brackets shown in the graph correspond to the numerals of the notes for Table 5.

TABLE 5

| Experiment No. | Condition: Zn (wt %) | Sn (wt %) | Hg (wt %) | Weight of Hg (mg) | Total weight (mg) | Result: Flickering | Film peeling | Tackiness (Adhesion to thin tube) | Overall evaluation |
|---|---|---|---|---|---|---|---|---|---|
| 1 | 25 | 25 | 50 | 5 | 10.0 | ○ | ○ | x(1) | x |
| 2 | 25 | 30 | 45 | 5 | 11.1 | ○ | ○ | ○ | ○ |
| 3 | 25 | 40 | 35 | 5 | 14.3 | ○ | ○ | ○ | ○ |
| 4 | 25 | 50 | 25 | 5 | 20.0 | ○ | ○ | ○ | ○ |
| 5 | 25 | 55 | 20 | 5 | 25.0 | x(2) | ○ | ○ | x |
| 6 | 10 | 40 | 50 | 5 | 10.0 | ○ | ○ | x(3) | x |
| 7 | 15 | 40 | 45 | 5 | 11.1 | ○ | ○ | ○ | ○ |
| 8 | 20 | 40 | 40 | 5 | 12.5 | ○ | ○ | ○ | ○ |
| 9 | 30 | 40 | 30 | 5 | 16.7 | ○ | ○ | ○ | ○ |
| 10 | 35 | 40 | 25 | 5 | 20.0 | x(4) | ○ | ○ | x |
| 11 | 5 | 60 | 35 | 5 | 14.3 | ○ | ○ | x(5) | x |
| 12 | 10 | 55 | 35 | 5 | 14.3 | ○ | ○ | ○ | ○ |
| 13 | 20 | 45 | 35 | 5 | 14.3 | ○ | ○ | ○ | ○ |
| 14 | 30 | 35 | 35 | 5 | 14.3 | ○ | ○ | ○ | ○ |
| 15 | 35 | 30 | 35 | 5 | 14.3 | x(6) | ○ | ○ | x |

Note
(1),(3)As the Hg content was in excess of the appropriate ratio, Hg leaked, thereby causing tackiness to occur.

Note
(2)As Sn was increased while Hg was decreased as compared with the appropriate ratio, an amount of Hg released in an initial stage was small, thereby causing flickering to occur.

Note
(4)As Zn was increased while Hg was decreased as compared with the appropriate ratio, an amount of Hg released in an initial stage was small, thereby causing flickering to occur.

Note
(5)As Zn was decreased while Sn was increased as compared with the appropriate ratio, Hg leaked, thereby causing tackiness to occur.

Note
(6)As Zn was increased while Sn was decreased as compared with the appropriate ratio, an amount of Hg released in an initial stage was small, thereby causing flickering to occur.

As clear from Table 4, the compositions in the range of the present invention caused none of flickering, film peeling, and tackiness, and exhibited excellent overall evaluation results.

INDUSTRIAL APPLICABILITY

Fluorescent lamps according to the present invention are applicable as mercury discharge lamps in which mercury is used.

The invention claimed is:

1. An amalgam pellet for use in a fluorescent lamp, the fluorescent lamp including a glass bulb provided with a phosphor film on its internal face, in which a rare gas is enclosed, wherein the amalgam pellet contains zinc, tin, and mercury, has a weight of not more than 20 mg per each pellet, and has a composition of $Zn_aSn_bHg_c$, where a, b, and c are values in percent by weight satisfying $10 \leqq a \leqq 30$, $30 \leqq b \leqq 65$, and $25 \leqq c \leqq 45$.

2. The amalgam pellet according to claim 1, wherein the amalgam pellet releases mercury at least at a temperature of 260° C.

3. The amalgam pellet according to claim 1, wherein the amalgam pellet further contains less than 10 percent by weight of at least one element selected from bismuth, lead, indium, cadmium, strontium, calcium, and barium.

4. The amalgam pellet according to claim 1, wherein the amalgam pellet is made of a mixture of ZnHg and SnHg.

5. The amalgam pellet according to claim 1, wherein the amalgam pellet has an approximately spherical shape and an average spherical diameter of not less than 0.3 mm and less than 3.0 mm.

* * * * *